US007705538B2

(12) United States Patent
Grundmann et al.

(10) Patent No.: US 7,705,538 B2
(45) Date of Patent: Apr. 27, 2010

(54) HIGH-PRESSURE DISCHARGE LAMP

(75) Inventors: Dirk Grundmann, Berlin (DE); Andreas Naujoks, Birkenwerder (DE); Conrad Schimke, Berlin (DE); Frank Werner, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 343 days.

(21) Appl. No.: 11/791,486

(22) PCT Filed: Nov. 18, 2005

(86) PCT No.: PCT/DE2005/002072

§ 371 (c)(1),
(2), (4) Date: May 24, 2007

(87) PCT Pub. No.: WO2006/058513

PCT Pub. Date: Jun. 8, 2006

(65) Prior Publication Data

US 2007/0296339 A1 Dec. 27, 2007

(30) Foreign Application Priority Data

Nov. 30, 2004 (DE) ..... 10 2004 057 906

(51) Int. Cl.
*H01J 17/04* (2006.01)

(52) U.S. Cl. ..... 313/631; 313/332

(58) Field of Classification Search ..... 313/623–625, 313/631, 331, 332, 491, 492, 615, 632, 271, 313/272

See application file for complete search history.

(56) References Cited

U.S. PATENT DOCUMENTS

| | | | | |
|---|---|---|---|---|
| 5,936,350 | A | 8/1999 | Yoshida et al. | |
| 6,121,729 | A | 9/2000 | Takao et al. | |
| 6,137,228 | A | 10/2000 | Aizawa et al. | |
| 6,856,079 | B1 * | 2/2005 | Zhu | 313/326 |
| 2003/0178940 | A1 | 9/2003 | Yoshida et al. | |

FOREIGN PATENT DOCUMENTS

| | | |
|---|---|---|
| DE | 198 12 298 | 10/1998 |
| EP | 0 858 098 | 8/1998 |
| EP | 1465237 | 10/2004 |

* cited by examiner

*Primary Examiner*—Joseph L Williams
*Assistant Examiner*—Andrew J Coughlin

(57) ABSTRACT

A high-pressure discharge lamp includes a quartz glass discharge chamber (1) having at least one end (11) provided with a molybdenum film sealing element (2) and at least one electrode (4) which is connected to the sealing element (2) and is protruded in the lower chamber (10) of the discharge chamber (1), wherein the lamp includes a spiral (5) whose slope is equal to or greater than 600% and which encompasses the part of the electrode (4) in the end (11) area provided with the sealing element (2) of the discharge chamber (1) outside of the sealing element (2).

8 Claims, 2 Drawing Sheets

HIGH-PRESSURE DISCHARGE LAMP

Figure 1:
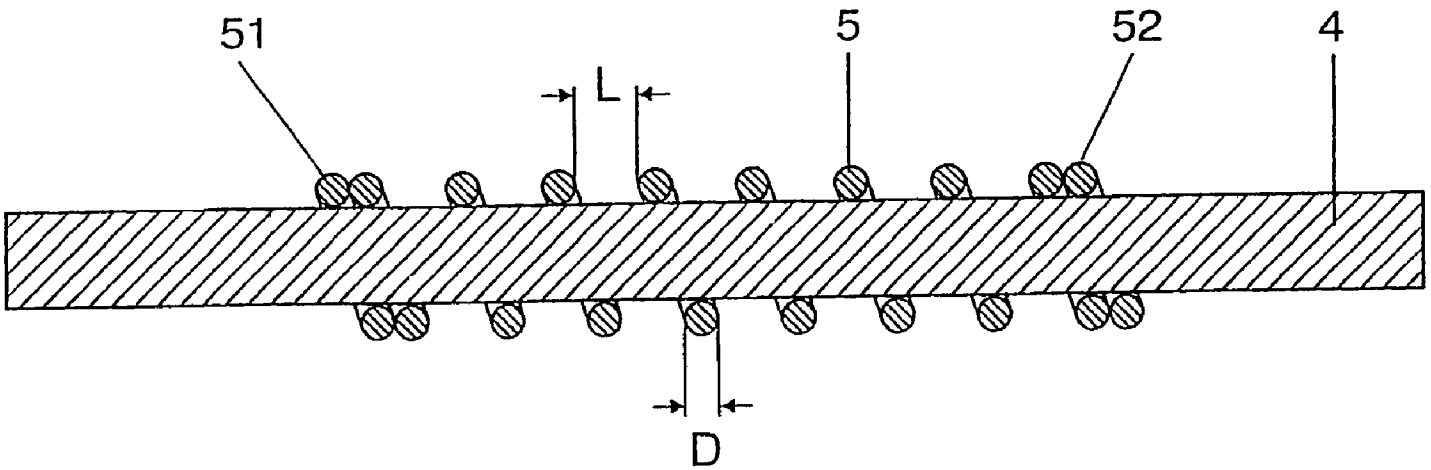

The invention relates to a high-pressure discharge lamp in accordance with the precharacterizing clause of patent claim 1.

I. PRIOR ART

Such a high-pressure discharge lamp has been disclosed, for example, in EP-A 0 858 098. This document describes a metal-halide high-pressure discharge lamp for a motor vehicle headlamp having a discharge vessel consisting of quartz glass, which has two ends provided with a molybdenum foil seal, and two electrodes, which are each connected to one of the molybdenum foil seals and protrude into the interior of the discharge vessel. One section of the respective electrode which is arranged in the region of that end of the lamp vessel which is provided with the molybdenum foil seal, outside of the molybdenum foil seal, is surrounded by a filament in order to avoid cracks in the quartz glass of the discharge vessel. The pitch of the filament is less than 600 percent and is preferably even less than 300 percent. The inner diameter of the filament is at least as large as the electrode diameter and smaller than 1.5 times the electrode diameter. One disadvantage here is the fact that, owing to the filament, cavities may be produced between the quartz glass and the electrode, into which cavities filling substances may enter from the discharge space. As a result, the molybdenum foil seal may be damaged.

DE 198 12 298 has disclosed a metal-halide high-pressure discharge lamp for a motor vehicle headlamp having a discharge vessel consisting of quartz glass, which has two ends provided with a molybdenum foil seal, and two electrodes, which are each connected to one of the molybdenum foil seals and protrude into the interior of the discharge vessel. The electrodes are each surrounded by a filament, the filament having, in the front region facing the discharge space, a tight winding density and being arranged at a distance from the electrode and, in the rear region facing the molybdenum foil seal, having a clearer winding density and bearing tightly against the electrode. One disadvantage here is the complex production method for the power supply line.

II. DESCRIPTION OF THE INVENTION

The object of the invention is to provide a high-pressure discharge lamp of the generic type having improved power supply lines, which avoid the disadvantages of the prior art.

This object is achieved according to the invention by the features of patent claim 1. Particularly advantageous embodiments of the invention are described in the dependent patent claims.

The high-pressure discharge lamp according to the invention has a discharge vessel consisting of quartz glass, which has at least one end provided with a molybdenum foil seal, and at least one electrode, which is connected to the molybdenum foil seal and protrudes into the interior of the discharge vessel, a filament with a pitch of greater than or equal to 600 percent being provided which surrounds a section of the electrode which is arranged in the region of that end of the lamp vessel which is provided with the molybdenum foil seal, outside of the molybdenum foil seal. This ensures that no relatively large cracks can form in the region of the electrode in the quartz glass of the end of the discharge vessel which are brought about by the different thermal expansion of the electrode material and the quartz glass and would lead to failure of the lamp, and also that no filling substances can push forward from the interior of the discharge vessel to the molybdenum foil seals, which filling substances would cause corrosion of the molybdenum foils and would therefore damage the molybdenum foil seals.

Owing to the relatively high pitch of the abovementioned filament, its turns are far apart from one another, with the result that, when the end of the discharge vessel is sealed off, the softened quartz glass can enter between adjacent turns of the filament and can cover the surface of the electrode. Owing to its relatively high pitch, the filament also has a low thermal capacity, with the result that the quartz glass cools down more slowly as it flows around the filament and thus good sealing is achieved.

It is assumed that, during operation of the high-pressure discharge lamp, microscopically small cracks form in the quartz glass surrounding the electrode owing to the different coefficients of thermal expansion of the quartz glass and the electrode material, which cracks, owing to the existence of the filament, cannot grow to become larger cracks, which would cause a leak in the sealed end of the discharge vessel and would impair the ability of the high-pressure discharge lamp to function.

The wire diameter or the wire thickness of the filament wire is advantageously less than 100 micrometers in order not to significantly increase the diameter of the power supply line in the region of the electrode section surrounded by the filament. Advantageously, the wire diameter of the filament wire is matched to the electrode diameter in the range of from 0.25 millimeter to 0.4 millimeter, and preferably 0.30 millimeter to 0.35 millimeter, as are generally used in mercury-free metal-halide high-pressure discharge lamps for motor vehicle headlamps. The electrodes of this type of lamp are in the form of pin electrodes.

For manufacturing reasons, the first and last turns of the filament are more tightly wound than the filament section lying therebetween. It has been shown that, as a result, the desired effect of the filament is not impaired.

The invention is particularly well suited to high-pressure discharge lamps having a comparatively small discharge vessel volume of a maximum of 30 $mm^3$, whose ionizable filling contains metal halides and xenon, and having relatively thick electrodes with a diameter in the range of from 0.25 mm to 0.4 mm, such as, for example, the abovementioned mercury-free metal-halide high-pressure discharge lamps for motor vehicle headlamps.

III. DESCRIPTION OF THE PREFERRED EXEMPLARY EMBODIMENT

Figure 2:
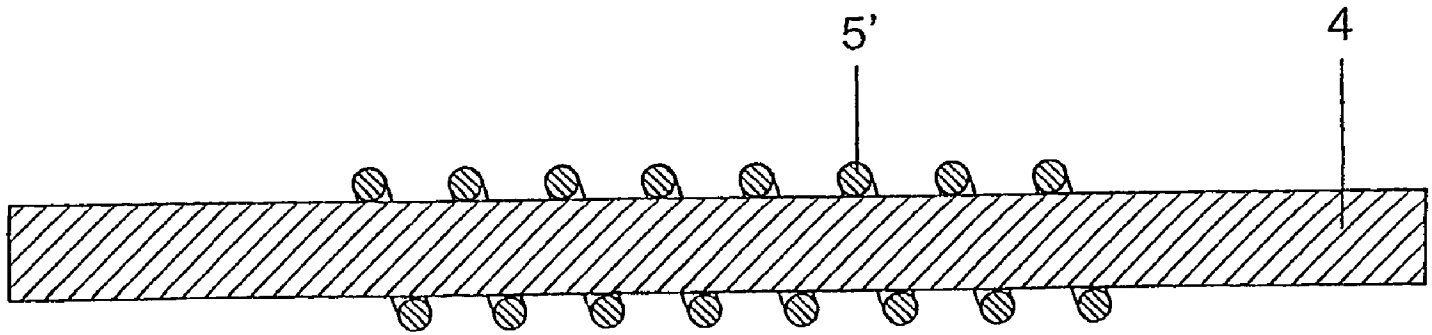
Figure 3:
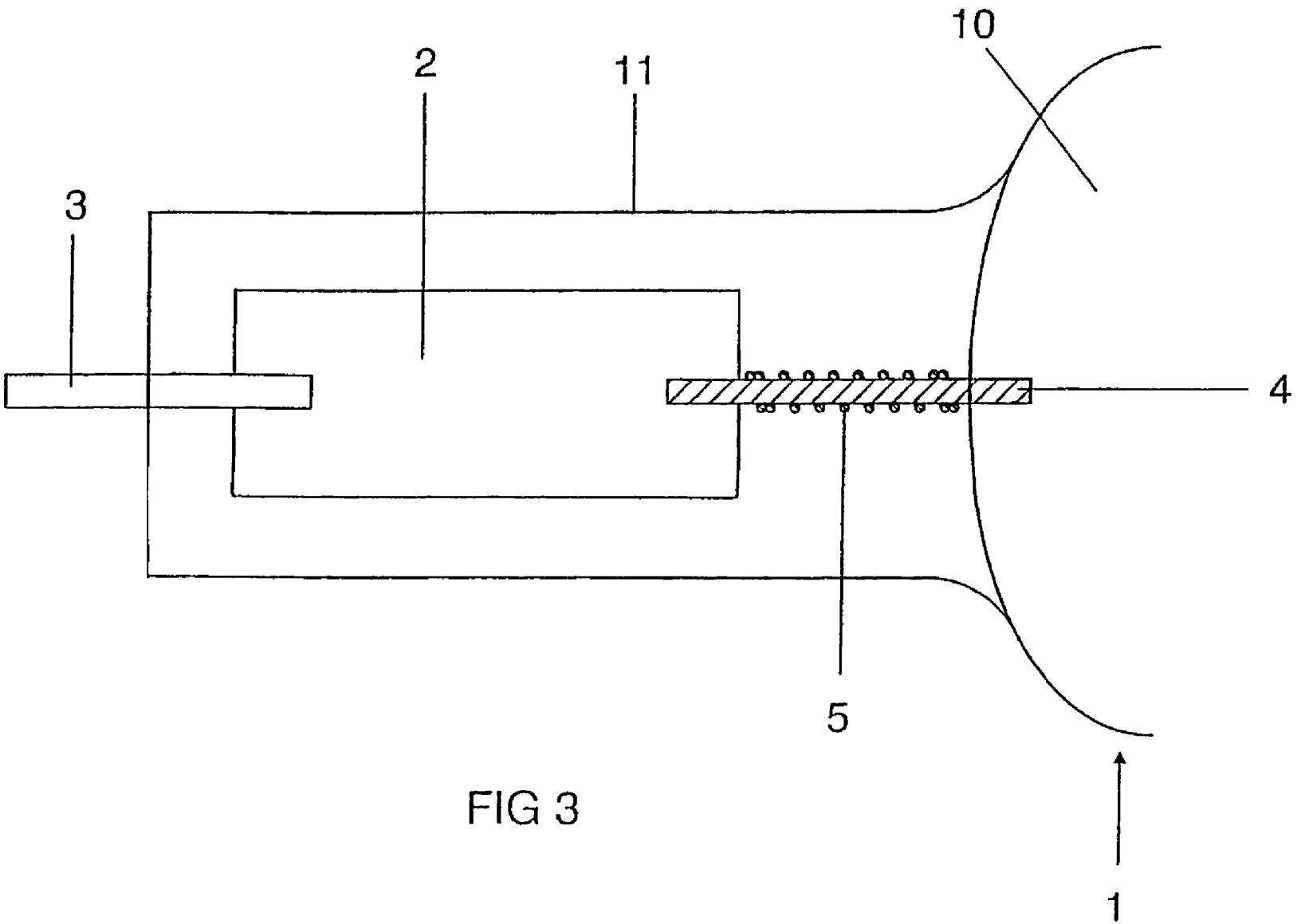

The invention will be explained in more detail below with reference to a preferred exemplary embodiment. In the drawing:

FIG. 1 shows an electrode for a high-pressure discharge lamp in accordance with the preferred exemplary embodiment of the invention with a filament arranged on the electrode, FIG. 2 shows an electrode for a high-pressure discharge lamp in accordance with the second exemplary embodiment of the invention with a filament arranged on the electrode, and FIG. 3 shows a sealed end of the discharge vessel of a high-pressure discharge lamp in accordance with the preferred exemplary embodiment of the invention with the electrode depicted in FIG. 1.

FIG. 3 shows one end 11, which is closed by means of a molybdenum foil seal, of a discharge vessel 1, which is sealed at two ends, of a high-pressure discharge lamp for a motor vehicle headlamp in accordance with the preferred exemplary embodiment of the invention, including the power supply line, which is passed through the closed end 11 of the discharge vessel 1. The lamp is in particular a mercury-free metal-halide high-pressure discharge lamp having an electrical power consumption of 35 watts. An ionizable filling, which consists of xenon and the halides of the metals sodium, scandium, zinc and indium, is arranged in the interior 10 of the discharge vessel 1. The volume of the discharge vessel is 0.24 $mm^3$.

The power supply line has a molybdenum foil 2, which is embedded in a gas-tight manner in the closed end 11 of the discharge vessel 1. The molybdenum foil 2 has a length of 6.5 mm, a width of 2 mm and a thickness of 25 μm. That end of the molybdenum foil 2 which faces away from the interior 10 of the discharge vessel 1 is welded to a molybdenum wire 3, which protrudes out of the sealed end 11 of the discharge vessel 1. That end of the molybdenum foil 2 which faces the interior 10 of the discharge vessel 1 is welded to a bar-type electrode 4 which consists of tungsten and protrudes into the discharge space 10. The length of the electrode 4 is 7.5 mm, and its thickness or its diameter is 0.30 mm. The overlap between the electrode 4 and the molybdenum foil 2 is 1.30 mm±0.15 mm. A filament 5 is arranged centrally on the electrode 4 such that its distance from the two ends of the electrode 4 is in each case 2.25 mm. The filament 5 has a length of 3 mm. It consists of a tungsten wire, whose wire thickness or wire diameter is D=60 μm. The inner diameter of the filament 5 corresponds to the diameter or the thickness of the electrode 4. In accordance with the preferred exemplary embodiment of the invention, as is illustrated schematically in FIG. 1, the filament 5 extends only over that section of the electrode 4 which is arranged in the closed end 11 of the discharge vessel 1 and which does not overlap with the molybdenum foil 2. The distance between the filament 5 and the molybdenum foil 2 is 0.95 mm. However, the filament 5 can also protrude into the discharge space 10. As a result, its effect is not impaired. The other closed end of the discharge vessel 1 (not illustrated) has an identical design to the end 11. In particular, it likewise has an electrode, as illustrated in FIGS. 1 and 3. The distance between those ends of the two electrodes which protrude into the interior 10 of the discharge vessel 1 is 4.2 mm. The two electrodes are arranged opposite one another, in the longitudinal axis of the discharge vessel 1.

FIG. 1 shows an enlarged illustration of the electrode 4 and the filament 5 of the end 11 of the discharge vessel 1. Apart from the first turn 51 and the last turn 52 of the filament 5, the distance L between two adjacent turns is 340 μm. The pitch S of a filament is calculated from the distance L and the filament wire diameter D as S=(L+D)/D. The pitch of the filament 5 is therefore, apart from its first and last turns, 6.67 or 667 percent.

FIG. 2 shows a schematic illustration of the electrode 4 and the filament 5' in accordance with the second exemplary embodiment of the invention. This exemplary embodiment differs from the first, preferred exemplary embodiment only by the filament 5'. With the filament 5', the first and last turns are also arranged at a distance of 340 μm from their respective adjacent turn, with the result that the filament 5' continuously has a pitch of 667 percent. In all other details, the filaments 5 and 5' correspond to one another.

The high-pressure discharge lamp in accordance with the preferred exemplary embodiment also has an outer bulb, which surrounds the discharge vessel 1 in the region of the discharge space 10, and a lamp base. These details are described and illustrated by way of example in EP 1 465 237 A2.

The invention is not restricted to the exemplary embodiments explained in more detail above. For example, the inner diameter of the filament 5 or 5' may also be larger than the diameter of the electrode 4. Good results are also achieved with a filament 5 whose inner diameter is 0.33 mm and which is arranged on an electrode 4 having a diameter of 0.30 mm and which is identical in terms of its other dimensions to the filament 5 of the first exemplary embodiment.

The invention claimed is:

1. A high-pressure discharge lamp having a discharge vessel consisting of quartz glass, which has at least one end provided with a molybdenum foil seal, and having at least one electrode, which is connected to the molybdenum foil seal and protrudes into the interior of the discharge vessel, a filament being provided which surrounds a section of the electrode, which section is arranged in the region of that end of the discharge vessel which is provided with the molybdenum foil seal, outside of the molybdenum foil seal, wherein the pitch of the filament is greater than or equal to 600 percent, and wherein the first and last turns of the filament are more tightly wound than the section of the filament there between.

2. The high-pressure discharge lamp as claimed in claim 1, characterized in that the wire diameter of the filament wire of the filament is less than 100 micrometers.

3. The high-pressure discharge lamp as claimed in claim 2, characterized in that that section of the at least one electrode which is surrounded by the filament is cylindrical and has a diameter in the region of greater than 0.25 millimeter and less than 0.4 millimeter, preferably in the range from 0.30 millimeter to 0.35 millimeter.

4. The high-pressure discharge lamp as claimed in claim 3, characterized in that the volume of the discharge vessel is less than or equal to 30 $mm^3$, and the ionizable filling arranged in the interior of the discharge vessel contains metal halides and xenon.

5. The high-pressure discharge lamp as claimed in claim 2, characterized in that the volume of the discharge vessel is less than or equal to 30 $mm^3$, and the ionizable filling arranged in the interior of the discharge vessel contains metal halides and xenon.

6. The high-pressure discharge lamp as claimed in claim 1, characterized in that that section of the at least one electrode which is surrounded by the filament is cylindrical and has a diameter in the region of greater than 0.25 millimeter and less than 0.4 millimeter, preferably in the range from 0.30 millimeter to 0.35 millimeter.

7. The high-pressure discharge lamp as claimed in claim 6, characterized in that the volume of the discharge vessel is less than or equal to 30 $mm^3$, and the ionizable filling arranged in the interior of the discharge vessel contains metal halides and xenon.

8. The high-pressure discharge lamp as claimed in claim 1, characterized in that the volume of the discharge vessel is less than or equal to 30 $mm^3$, and the ionizable filling arranged in the interior of the discharge vessel contains metal halides and xenon.

* * * * *